United States Patent [19]

Mead et al.

[11] Patent Number: 4,603,332

[45] Date of Patent: Jul. 29, 1986

[54] INTERLEAVED MICROSTRIP PLANAR ARRAY

[75] Inventors: James B. Mead, Brookside, N.J.; Emile J. Deveau, Pleasantville, N.Y.; Leonard Schwartz, Montville, N.J.

[73] Assignee: The Singer Company, Little Falls, N.J.

[21] Appl. No.: 650,491

[22] Filed: Sep. 14, 1984

[51] Int. Cl.[4] ..... H01Q 1/28/1/38

[52] U.S. Cl. ..... 343/700 MS; 343/737; 343/705

[58] Field of Search ..... 343/700 MS, 770, 771, 343/737, 853, 705

[56] References Cited

U.S. PATENT DOCUMENTS 3,508,275 4/1970 Deveau et al. ..... 343/771
4,180,817 12/1979 Sanford ..... 343/700 MS
4,340,892 7/1982 Brunner et al. ..... 343/771
4,347,516 8/1982 Shrekenhamer ..... 343/700 MS

*Primary Examiner*—Eli Lieberman
*Attorney, Agent, or Firm*—Thomas W. Kennedy

[57] ABSTRACT

Two separate microstrip antennas are interleaved in the same plane thereby occupying substantially the same area as a single antenna. Each antenna aperture produces two beams and the configuration for each antenna includes a single feed on each planar array which results in lowered overwater bias error. Each planar array antenna can have radiating arrays of different radiator spacing. Using forward firing arrays for one antenna and backward firing arrays for the other antenna, a radiated spacing is chosen for each interleaved antenna which results in temperature compensation in the along track direction.

5 Claims, 19 Drawing Figures

AMPLITUDE FUNCTION $A(x,y) = f(x) \cdot g(y)$

TRUNCATED SLANTED APERATURE

TO FIG. 9B

INTERLEAVED MICROSTRIP PLANAR ARRAY

BRIEF DESCRIPTION OF THE PRIOR ART

The most relevant known prior art is co-pending patent application Ser. No. 378,575 to Schwartz, et al, filed May 17, 1982, which is assigned to the present assignee. This prior art antenna is a single aperture microstrip antenna which has feeds on opposite ends of an array. Although it operates generally satisfactorily under certain circumstances it exhibits high temperature sensitivity and less than a desirable degree of overwater compensation. In part, these shortcomings can be attributed to the necessity of using a single aperture antenna to produce four beams required for Doppler Radar operation.

BRIEF DESCRIPTION OF THE PRESENT INVENTION

The patentable features of the present antenna design, as compared with the mentioned prior art is based upon the utilization of two separate microstrip antennas which are interleaved with each other to occupy, substantially the same room as a single antenna. In this configuration, each antenna aperture produces only two beams as opposed to the previous mentioned prior art which produces four beams from a single aperture. Thus, the configuration for each antenna is a single feed on each planar array rather than a feed at each end of the array as exists in the prior art approach.

A first significant advantage is that along track temperature compensation can be achieved due to the fact that each planar array antenna can have radiating arrays of different radiator spacing. Using forward-firing arrays for one antenna and backward-firing arrays for the other antenna, a radiator spacing can be chosen for each interleaved antenna which results in temperature compensation in the along track direction. A second distinct advantage of the present invention is that overwater bias error is significantly lower using this configuration. This results from the fact that, since the antenna is fed from only one end, the amplitude function required to achieve low overwater error needs to be modified once to feed from either end of the feed array. In the case of the previously mentioned prior art, it has been necessary to modify the amplitude function twice because the radiating array has to be fed from both ends.

A still further advantage of the present invention is lower gamma beamwidth because the amplitude function can be optimized for feeding from a single end of the antenna.

BRIEF DESCRIPTION OF THE FIGURES

The above-mentioned objects and advantages of the present invention will be more clearly understood when considered in conjunction with the accompanying drawings, in which.

DETAILED DESCRIPTION OF THE INVENTION

Figure 1A:
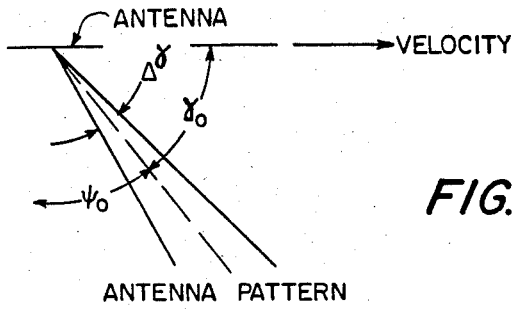
FIG. 1*a* is a diagram showing a typical antenna radiation pattern.
Figure 1B:
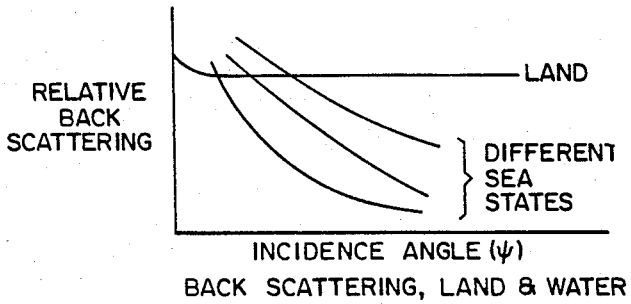
FIG. 1*b* illustrates typical back scattering functions.
Figure 1C:
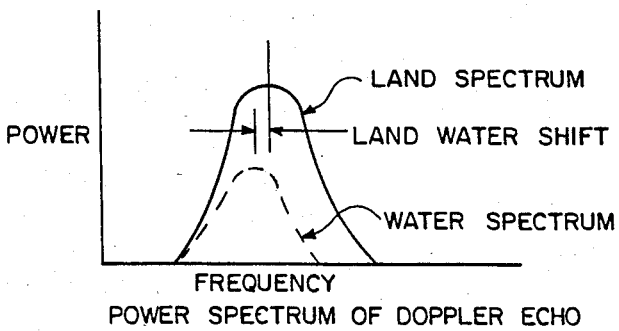
FIG. 1*c* is a further diagram showing the effect of land-water shift.

Regardless of the technique used to track a Doppler echo, all Doppler Radars will experience a land-water shift unless specific effort is taken in the design to eliminate this shift. To discuss the mechanism of the land-water shift, consider a simple single-beam system where $\gamma_0$ (the angle between the velocity vector and the center of the radiated beam) and $\Psi_0$ (the incidence angle of the beam on to the scattering surface) are in the same plane and are complementary, as shown in FIG. 1*a*. The antenna beam width is labeled $\Delta\gamma$. Over land, the uniform backscattering (FIG. 1*b*) results in a spectrum whose center is a function of $\gamma_0$ and whose width is a function of $\Delta\gamma$ (FIG. 1*c*). When flying over water, the backscattering is non-uniform as shown in FIG. 1*b* with the large $\Psi$ angles (small $\gamma$ angles) having a lower scattering coefficient. Since the smaller $\gamma$ angles are associated with the higher frequencies of the Doppler spectrum, the latter are attenuated with respect to the lower frequencies thereby shifting the spectrum peak to a lower frequency. The land-water shift generally is from 1 percent to 3 percent depending on the antenna parameters.

Figure 3A:
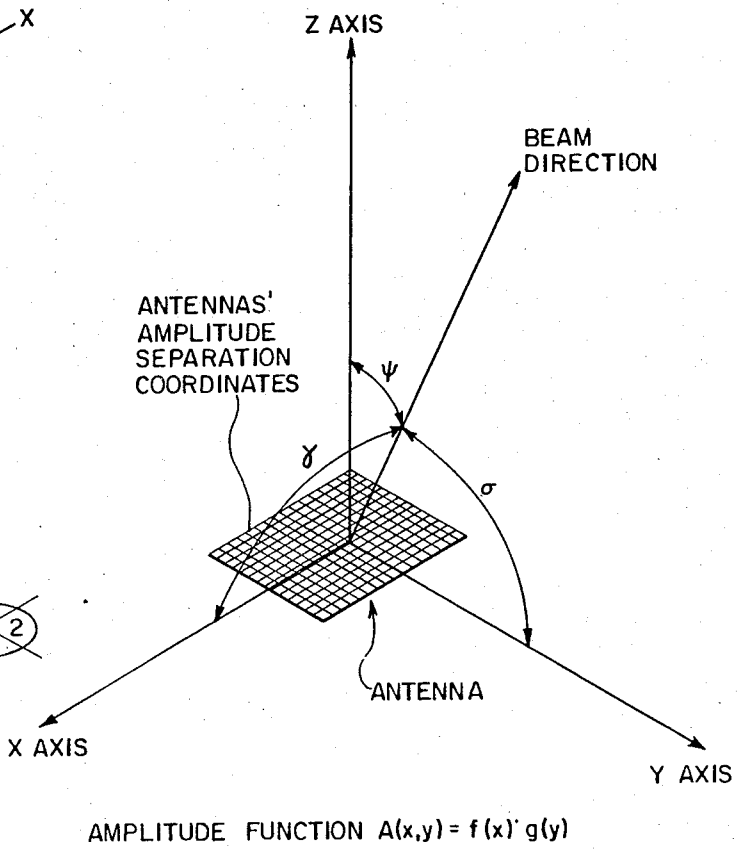
FIG. 3*a* is a diagram of a coordinate system for a conventional rectangular antenna.

The three-dimensional situation is more complicated. Assume an aircraft is traveling along axis X in FIG. 2. Axis Y is horizontal and orthogonal to axis X, while axis Z is vertical. Rectangular arrays generate four beams at an angle to these axes. The axis of any one of these beams (e.g., beam 2) is at an angle $\gamma_0$ to the X-axis, at an angle $\sigma_0$ to the Y axis, and at an angle $\Psi_0$ to the Z axis. A conventional rectangular antenna, shown in FIG. 3*a*, has an amplitude function A which can be described as a product of two separate functions on the X axis and Y axis. Thus:

$$A(x,y)=f(x)\cdot g(y)$$

The antenna pattern for a conventional rectangular antenna is therefore said to be "separable" in $\gamma$ and $\sigma$. Since the scattering coefficient over water varies with angle, it is desirable to have an antenna pattern which is separable in $\gamma$ and $\Psi$ instead of $\gamma$ and $\sigma$. This type of antenna pattern would largely eliminate the land-water shift.

Figure 3C:
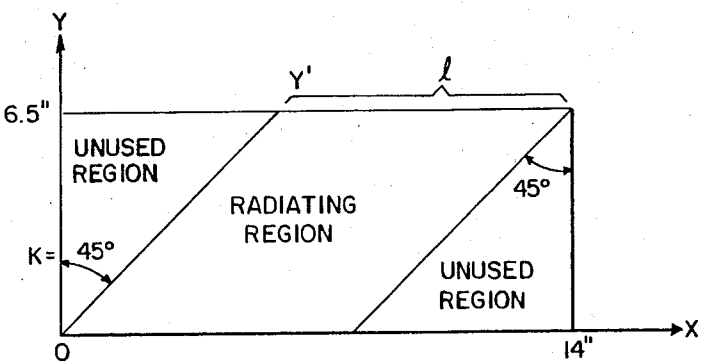
FIG. 3*c* is a diagram of a slanted aperture antenna with a slant angle of 45 degrees.
Figure 3B:
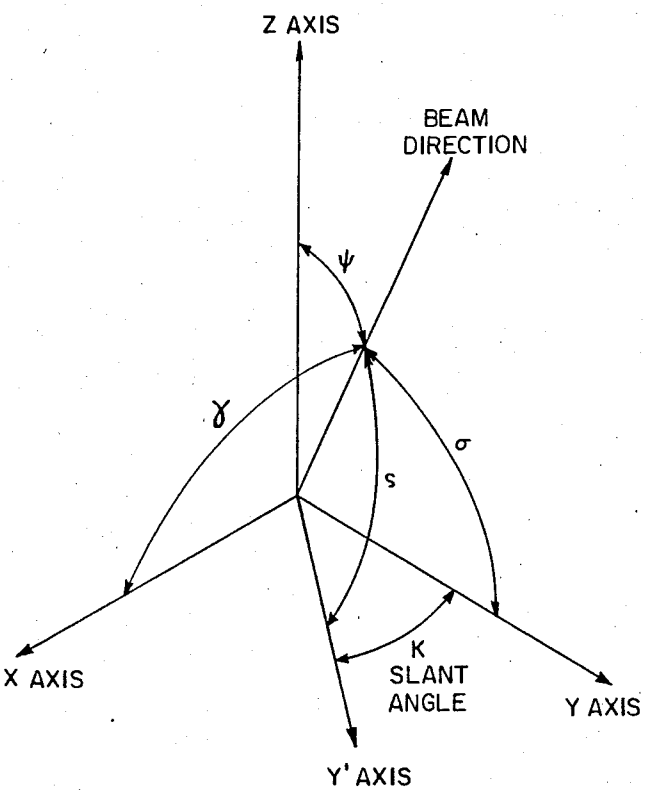
FIG. 3*b* is a diagram of a slanted axis coordinate system.

FIG. 3*b* shows a slanted-axis coordinate system intended to achieve an antenna pattern separable in $\Psi$ and $\gamma$. The Y′ axis is a projection of the beam axis onto the X—Y plane. The Y′ axis is at angle K to the Y axis.

FIG. 3*c* shows a slanted aperture antenna with a slant angle of K=45°. The amplitude function for this antenna is a product of two separate functions on the X axis and Y′ axis.

$$A(x,y')=f'(x)\cdot g'(y')$$

The antenna pattern for the slanted aperture antenna is separable in $\gamma$ and $\xi$, where $\xi$ is the angle between the Y′ axis and the beam axis. Near the center of the beam, the antenna pattern is also separable (to a close approximation) in $\gamma$ and $\Psi$, and is thus largely independent of the land-water shift. However, FIG. 3*c* also shows that the slanted aperture antenna leaves substantial parts of the rectangular mounting area unused. Thus, the gain for the slanted aperture antenna is lower than if the entire rectangular area contained radiating elements. Furthermore, the shortness of the radiating arrays in the slanted array antenna limits the number of radiating elements in each array, which can produce an unacceptably low insertion loss.

Figure 4:
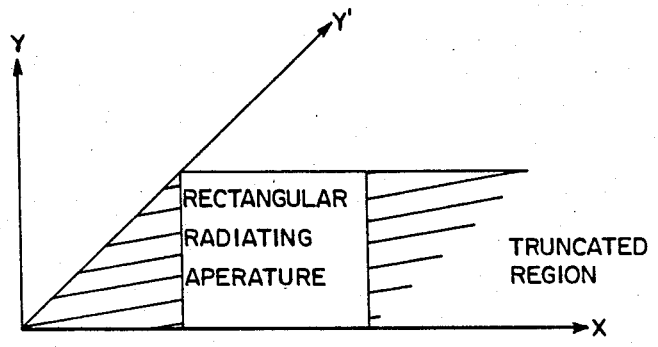
FIG. 4 is a diagrammatic representation of a truncated slanted aperture.

However, as shown in FIG. 4, it is possible to generate a slanted aperture, truncate it and derive a rectangular aperture which maintains the desired separability. Furthermore, it is possible to modify the slant angle such that a degree of overcompensation is achieved which counteracts the effects of truncating the original aperture. These are the basic design considerations of the present invention.

Figure 5:
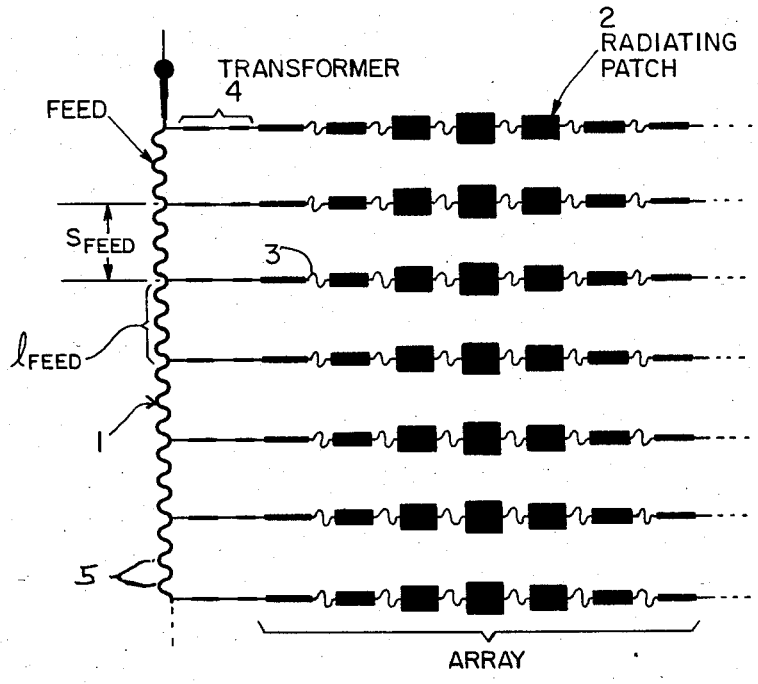
FIG. 5 PRIOR ART
FIG. 5 illustrates a section of a prior art antenna structure.

In a typical microstrip antenna of the type described in the mentioned prior art and shown in FIG. 5, a single feed, indicated at reference numeral 1, is attached to a plurality of arrays of patch radiators such as shown at 2. The patches are half-wave resonators, which radiate power from the patch edges, as described in the mentioned prior art reference. In order to control beam width, beam shape and side lobe level, the amount of power radiated by each patch must be set. The power radiated is proportional to the patch conductance, which is related to wavelength, line impedance and patch width. These patches are connected by phase links such as indicated at 3, which determine the beam angle relative to the axis of the arrays.

The arrays formed by patches and phase links are connected to the feed line through a two-stage transformer 4 which adjusts the amount of power tapped off the feed 1 into the array. The feed is made up of a series of phase links 5 of equal length, which control the beam angle in the plane perpendicular to the arrays. The feed is also a traveling wave structure. The power available at any given point is equal to the total input power minus the power tapped off by all previous arrays. These structures are broadband limited only by the transmission medium and the radiator bandwidth. In this case, the high Q of the patch radiators limits the bandwidth to a few percent of the operating frequency.

The present invention conceptually operates as two independent antennas of the type discussed in connection with FIG. 5. However, implementation is achieved by interleaving two antennas so as to form superposed apertures in the same plane thereby minimizing the space necessary for the antennas.

Figure 6A:
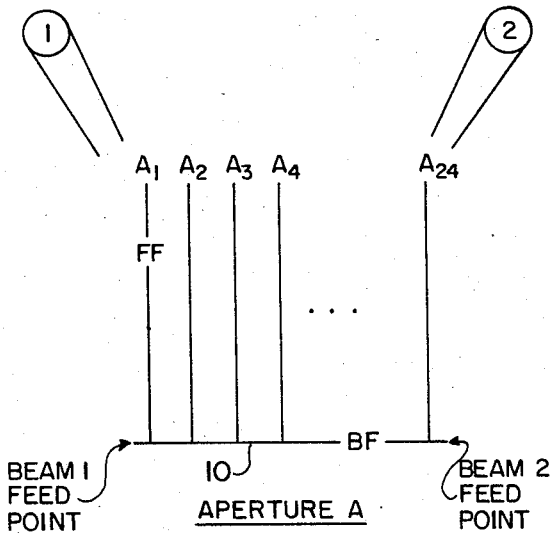
FIG. 6*a* is a simplified diagrammatic view of a first aperture of the present interleaved antenna structure.
Figure 6B:
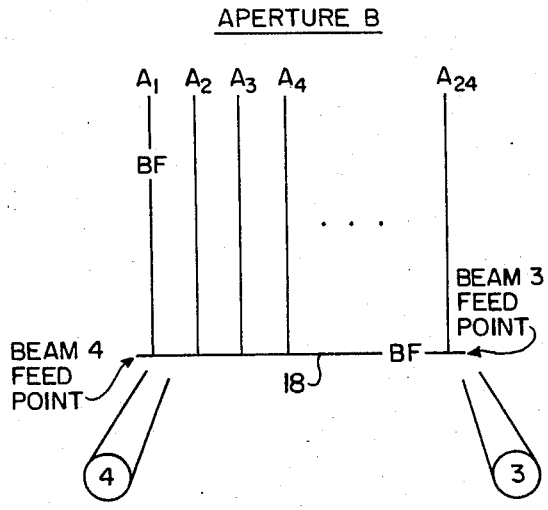
FIG. 6*b* is a simplified diagrammatic view of a second aperture of the present interleaved antenna structure.

The two apertures are diagrammed, in a simplified manner, in FIGS. 6*a* and 6*b*, respectively. Aperture A may, for example, consist of 24 forward fire arrays connected to a single back fire feed 10. Aperture B, shown in FIG. 6*b*, is similarly constructed with a single back fire feed 18. However, aperture B is provided with back fire arrays instead of the forward fire arrays of aperture A. A traveling wave entering a forward/back fire structure produces a beam in a forward/backward direction. The four beams and their associated feed points are shown. When driving the interleaved antenna structure, the various feed points are sequentially driven.

Figure 7:
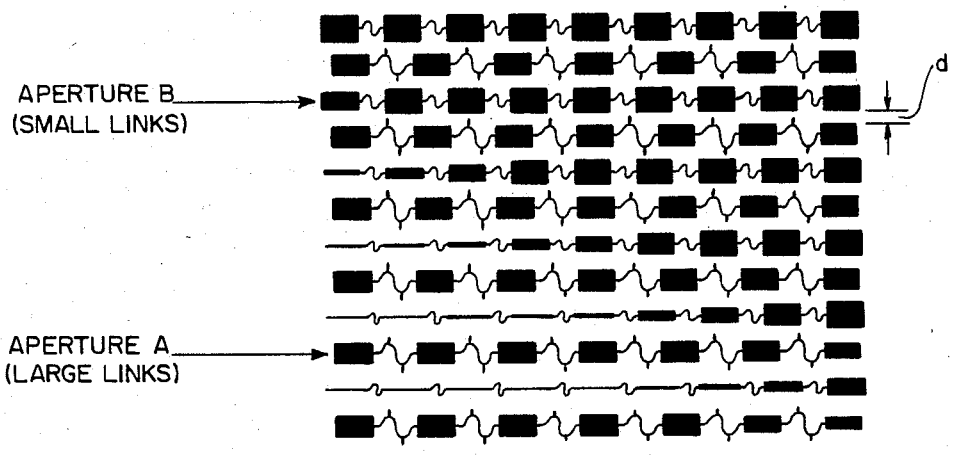
FIG. 7 illustrates a portion of the present antenna structure.

A partial view of the present interleaved antenna structure is shown in FIG. 7. The arrays wherein the radiating elements are interconnected by large links correspond to aperture A and these will be seen to occupy positions as even numbered arrays. Conversely, those radiating elements interconnected by small links correspond to aperture B and are seen to occupy the odd position arrays. Accordingly, the arrays of apertures A and B alternate in an interleaved, regularly alternating order. It is desirable to make the distance "d" between adjacent arrays as large as possible to assure good isolation between the two separate apertures. However, this would limit the patch width, making control of beam shaping difficult. Accordingly, the patch width values selected are a compromise to permit satisfactory performance for gamma image, side lobes and overwater error.

Figure 9A:
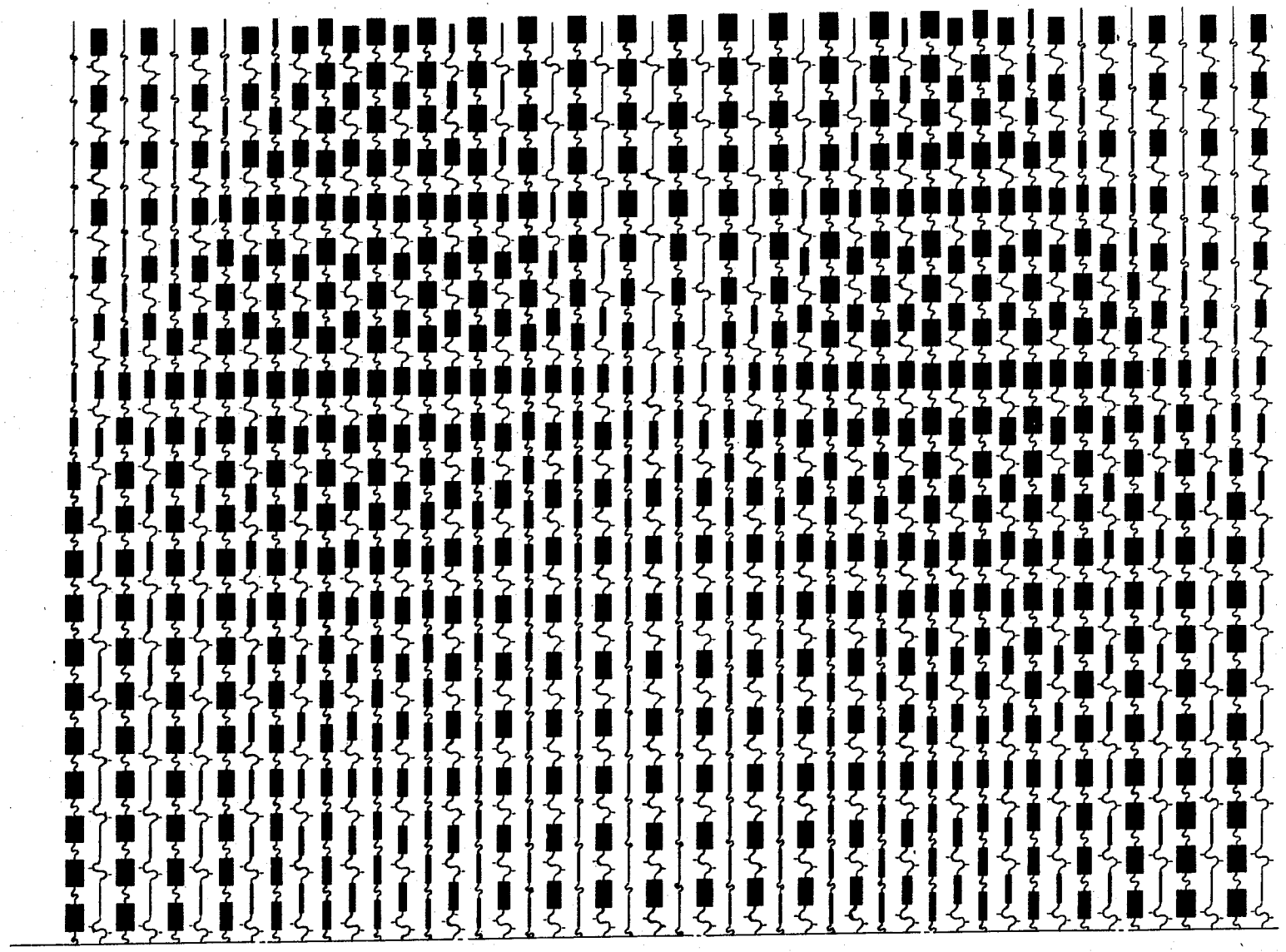
FIG. 9*a* illustrates the entire radiating plane of the present interleaved antenna.
Figure 9B:
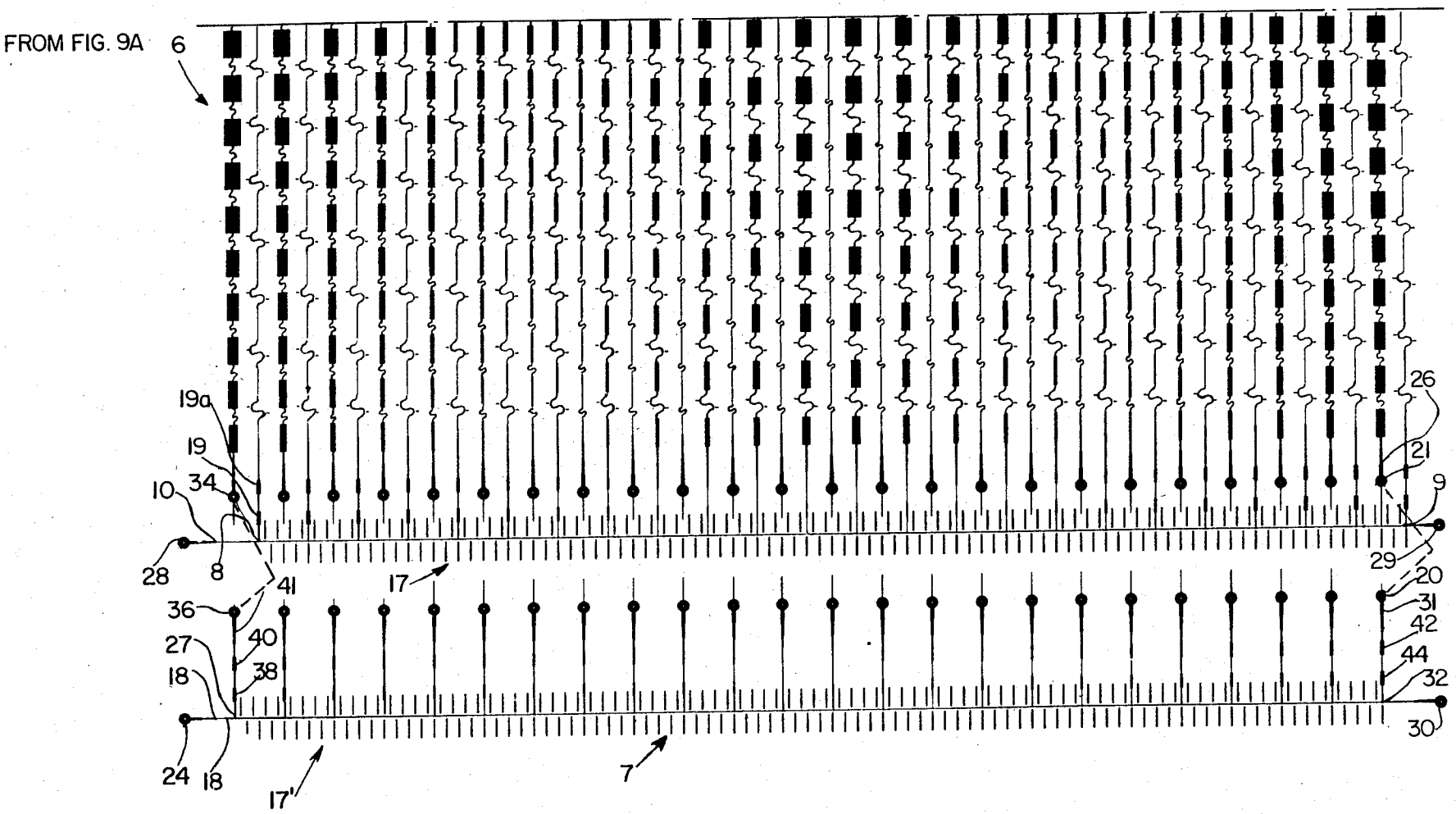
FIG. 9*b* is an illustration of a "feed-thru" connective portion of the present invention.

Referring to FIGS. 9*a* and 9*b*, reference numeral 6 generally indicates the printed circuit artwork for etching interleaved antennas of the present invention. As discussed in connection with FIG. 7, the alternating arrays of apertures A and B exist in co-planar relation. Feed line 10 is connected to each of the even positioned arrays corresponding to aperture A. Thus, for example, junction point 8 exists between feed line 10 and the second illustrated array via two-stage transformers 19 and 19*a*. Feed point 28 corresponds with the first beam as previously mentioned in connection with FIG. 6*a* while feed point 29 corresponds with the second beam of that figure. The rightmost array also corresponds with aperture A of FIG. 6*a* and this array is seen to be connected to feed line 10 at junction point 9. The feed point 29 at the right end of feed line 10 corresponds with the feed point for the second beam as described in connection with FIG. 6*a*.

In order to access the interleaved arrays of aperture B without interferring with aperture A, it is necessary to mount the feed for aperture B in insulated, spaced relation from the arrays of aperture A. To accomplish this end a feed-thru printed circuit strip 7 has been developed in the form of etched conductors as illustrated in FIG. 9*b*. In a preferred embodiment of the invention, the etched conductive portions of the main antenna structure (9*a*) and those of the feed-thru strip 7 are prepared on a single substrate and appropriately separated. By positioning the feed-thru strip 7 in insulated overlying relation with the interleaved antennas 6, power may be made to pass through feed 18 to individual backward-firing arrays of the interleaved antenna. Thus, for example, by driving feed point 24, corresponding to the fourth beam feed point of FIG. 6*b*, power is tapped off at junction point 27 through two-stage transformers 38 and 40 to the interconnected conductive section 41 terminating in feed-thru pad 36. With feed-thru strip 7 in appropriate overlying relation with the feed end of the interleaved antenna 6, feed-thru pad 36 is positioned in registry with feed-thru pad 34 of the first backward-firing array thereby completing a connection between the feed point 24 and the array. This feed-thru connection between pads 36 and 34 is indicated by a dotted line between FIGS. 9*a* and 9*b*. In a similar manner, feed point 30, corresponding to the third beam feed point of FIG. 6*b*, provides power to the rightmost illustrated backward firing array from tap off point 32 to feed-thru pad 20, via interconnected conductive section 31 and two-stage transformers 42 and 44. A feed-thru connection between pads 20 and 21 is indicated by the illustrated dotted line.

Figure 13:
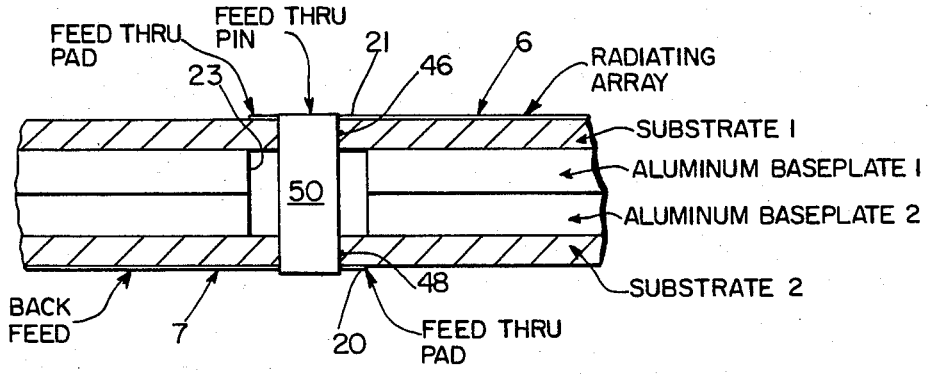
FIG. 13 is a detailed description of the feed-thru connections utilized in the present invention.

FIG. 13 is a detailed view of the feed-thru construction. By way of example, the feed-thru of the rightmost backward firing array of FIG. 9*a* is illustrated. The plane of the interleaved arrays 6 is illustrated as facing upwards while the conductive feed-thru strip 7 faces downward and their respective feed-thru pads 21 and 20 are positioned in spaced alignment. Openings 46 and 48 are respectively formed in substrate "1" and substrate "2" of the antenna and the feed-thru strip, respectively. An enlarged opening 23 is formed through aluminum baseplate "1" and aluminum baseplate "2," respectively attached to the antenna and feed-thru strip. The feed-thrus are completed by soldering pin 50 between the two etched feed-thru pads 20 and 21.

Considering the theory relative to frequency and temperature compensation, if a Doppler Radar system is to provide accurate velocity information, the beams produced by its antenna must remain as stable as possible. Beam angle drift as a function of frequency and temperature causes appreciable velocity error, and therefore must be minimized so that the relative distance between the four generated beams is maintained. The present antenna employs several techniques to achieve this, including use of alternate forward and back fire arrays, selection of different element spacing for each aperture. The governing equation for beam angle $$\cos\theta = \frac{(\sqrt{\xi}\ l - \lambda_0)}{S}$$

where:

$\theta$ is measured from the axis of the feed/array
S is the array-to-array or patch-to-patch spacing
l is the phase link length
$\xi$ is the dielectric constant
$\lambda_0$ is the free space wavelength The partial differentials of concern are:

$$d\theta/dt = \frac{(\cos\theta + \lambda_0/S)}{2\sin\theta}\,\alpha\xi\,\frac{\lambda_0\,\alpha S}{(S)\sin\theta}$$

$$d\theta/df = \frac{\lambda_0}{(S)(\sin\theta)(f)}$$

where:

$\alpha\xi$ is the dielectric temperature coefficient
$\alpha$S is the substrate expansion coefficient
f is the frequency in Hz
$\theta$ is expressed in radians These rates can be adjusted by changing the element spacings. All other parameters are either system or material constraints.

Figure 8:
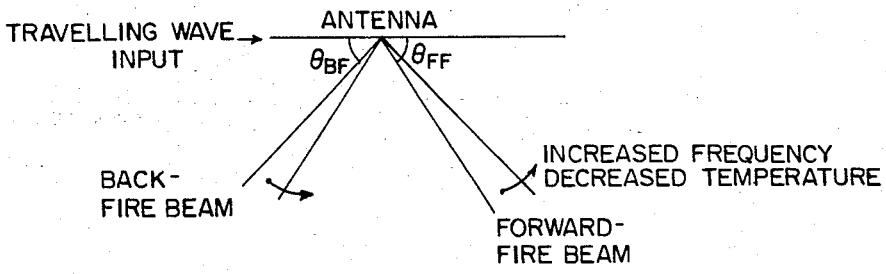
FIG. 8 is a geometric illustration of beam-pair compensation.

One way to compensate a beam pair is to minimize the *average* beam swing versus temperature and frequency. If a back fire and forward fire beam move at the same rate, as shown in FIG. 8, $\theta_{BF}$ will increase, $\theta_{FF}$ will decrease, but the average of their cosines will remain essentially constant.

In the present antenna the along track gamma beam pair is produced alternately by the forward fire arrays of aperture A and the back fire arrays of aperture B. By experimentally adjusting the back fire spacing and forward fire spacing, a compromise between frequency and temperature compensation is achieved.

Cross track velocity error is a function of changes in sigma, the angle controlled by the feed. Apertures A and B employ back fire feeds. Referring to FIG. 5, if the spacing $S_{feed}$ is chosen such that $l_{feed}=S_{feed}$, there results a straight feed line, which gives the largest array-to-array spacing possible with a first order back fire beam.

Such an arrangement as described above results in a minimum, but symmetrical movement of the beams with respect to the transverse antenna axis, and results in a minimum cross track velocity error while maintaining beam symmetry about the transverse axis. Alternatively, the feed lines 10 and 18 can be arranged such that one, say 10, is a forward-fire type and the other, say 18, is a backward-fire type. This arrangement will result in movement of one pair of transverse beams which will be opposite in direction to the other pair of transverse beams, and results in a cross track velocity error which does not change significantly with temperature and frequency.

Figure 10:
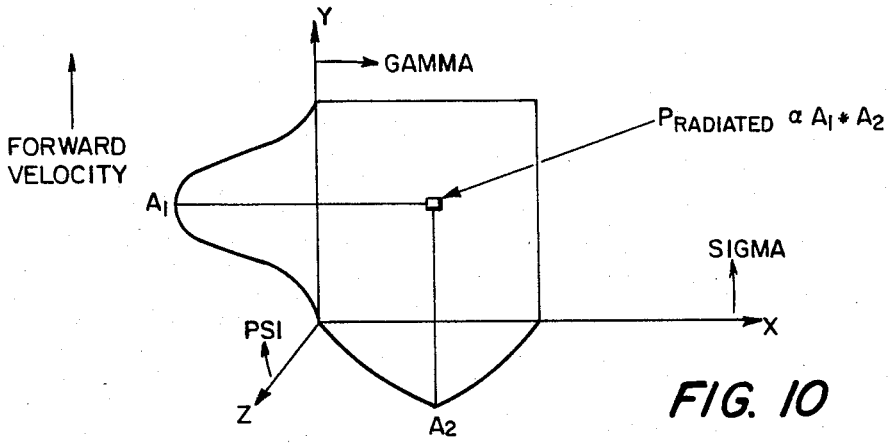
FIG. 10 illustrates orthogonal amplitude functions projected on a rectangular aperture.
Figure 11:
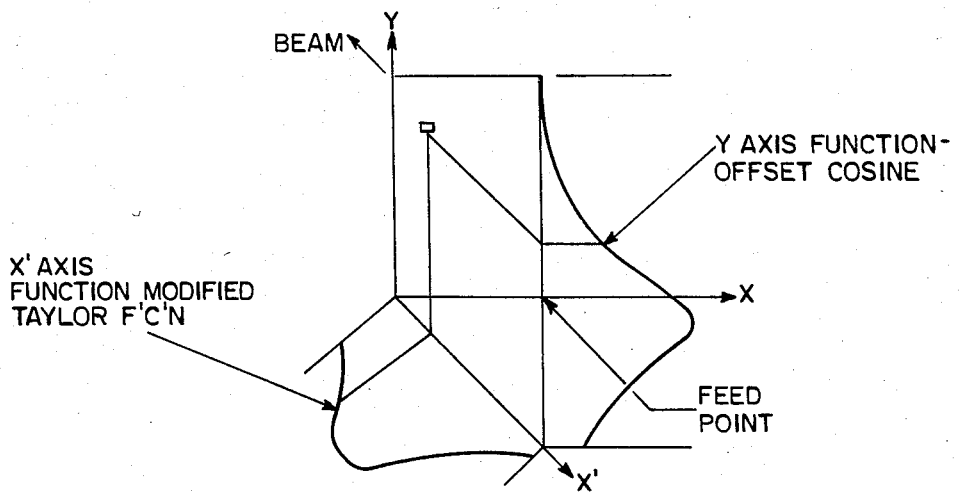
FIG. 11 illustrates skewed amplitude functions projected on a rectangular aperture.

The power radiated by each element on a rectangular antenna is normally determined by the product of amplitude functions which is along perpendicular axes, as shown in FIG. 10. These orthogonal functions will generate a beam that is separable in gamma and sigma angles measured from the X and Y axes to the beam. Gamma-psi separability can be approximated by an amplitude distribution generated by functions falling on the X′ and Y axes as shown in FIG. 11. This aperture will produce an overwater compensated beam in the second quadrant only.

Figure 12:
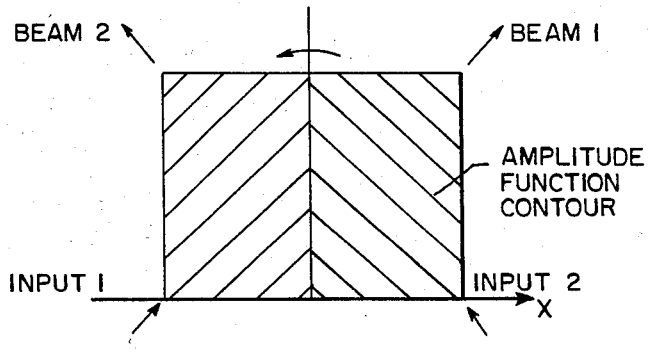
FIG. 12 illustrates slanted amplitude distribution for a two-beam aperture.

If two beams must be generated by the antenna, such as by apertures A and B of the present design, the amplitude distribution can be rotated around the Y axis producing compensated beams in the first and second quadrants, as shown in FIG. 12. Distortion of the beam shape occurs due to the change in slant on the second half of the aperture giving some loss of overwater compensation. However, this distortion is minimized by designing the antenna to radiate mostly from the input half of the aperture.

Overwater compensation for the invention is greatly enhanced since sigma feeds are employed, and since each aperture need only produce two beams.

Figure 2:
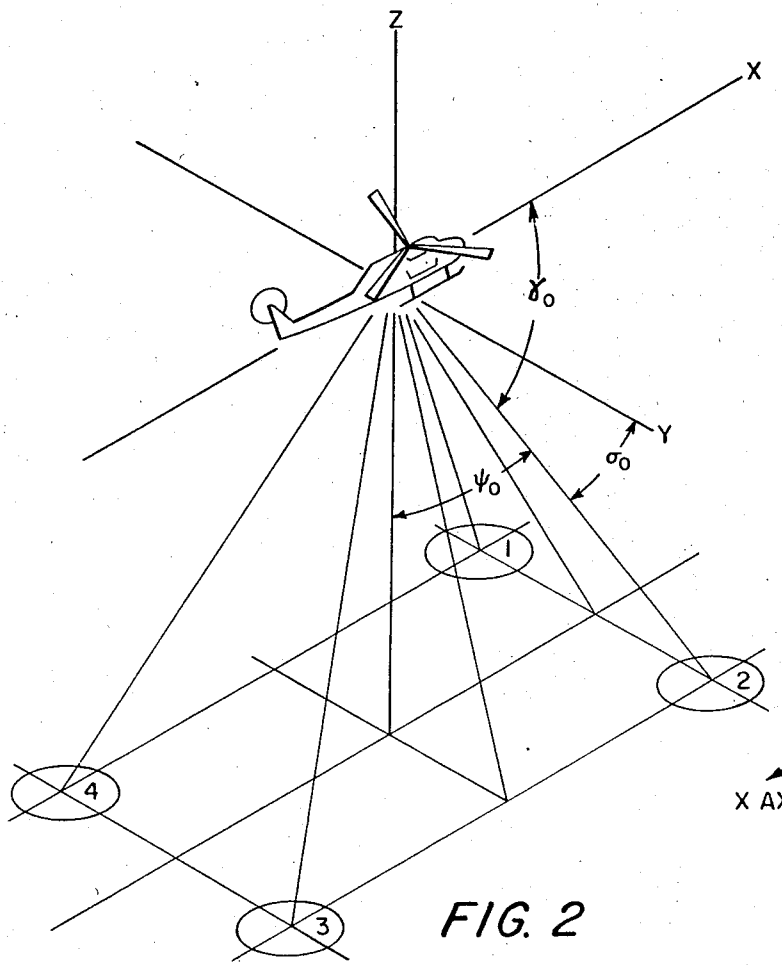
FIG. 2 is a diagram showing four radiated beams.

Another advantage of independent apertures is the ability to compensate for pitch angle bias found in certain applications. Some airframes may require the antenna to be mounted at a fixed angle to the X axis (FIG. 2). In that case, the forward beams must be pitched towards the antenna normal, while the backward beams must be pitched away from the antenna normal thus compensating for mounting pitch. Antennas using single radiating apertures cannot be pitch compensated since the beams cannot be moved independently.

It should be understood that the invention is not limited to the exact details of construction shown and described herein for obvious modifications will occur to persons skilled in the art.

We claim:

1. Microstrip antenna for Doppler radar navigation systems of airplanes or the like which includes several coplanar, mutually parallel rows of radiating elements connected with each other and two feed lines for supplying energy to the radiating element rows from their ends, wherein (a) there are provided a first group of forward firing radiating element rows ($A_1$ to $A_{24}$) and a second group of backward firing radiating element rows ($A'_1$ to $A'_{24}$), (b) the radiating element rows ($A_1$ to $A_{24}$) of said first group and the radiating element rows ($A'_1$ to $A'_{24}$) of said second group are interleaved forming a corresponding antenna aperture (for each group), and (c) the two feed lines (10, 18) each are connected only to the one ends of the radiating element rows ($A_1$ to $A_{24}$) of the first group and respectively to the one ends of the radiating element rows ($A'_1$ to $A'_{24}$) of the second group in order to radiate two radar beams for each antenna aperture, and wherein (d) the feed line (10) for the radiating element rows ($A_1$ to $A_{24}$) of the first group is designed straight and as a printed circuit (17) positioned in coplanar and transverse relation to said radiating element rows ($A_1$ to $A_{24}$), and (e) the feed line (18) for the radiating element rows ($A'_1$ to $A'_{24}$) of the second group is designed straight and as a printed circuit (17') positioned in transverse relation to said radiating element rows ($A'_1$ to $A'_{24}$), and (f) said printed circuit (17') and said radiating element rows ($A'_1$ to $A'_{24}$) are positioned in different planes to overlap each other and are connected with each other by feed-thru elements (50).

2. Antenna according to claim 1, wherein for temperature compensation in direction along the track the radiating element rows ($A_1$ to $A_{24}$) of the first group have another different radiating element spacing than the radiating element rows ($A'_1$ to $A'_{24}$) of the second group.

3. Antenna according to claim 1, wherein for compensation of the antenna mounting pitch with respect to the X-axis each antenna aperture provides a different radar beam angle.

4. Antenna according to claim 1, wherein the radiating element rows ($A_1$ to $A_{24}$, $A'_1$ to $A'_{24}$) are designed as a printed circuit (6).

5. Antenna according to claim 1, wherein the one feed line (10) is design forward-firing and the other feed line (18) is designed backward-firing.

* * * * *